US008487850B1

(12) United States Patent
Cole et al.

(10) Patent No.: US 8,487,850 B1
(45) Date of Patent: Jul. 16, 2013

(54) MULTI-SOURCE LCD BACKLIGHT FOR WHITE BALANCE ADJUSTMENT

(75) Inventors: James R Cole, Albany, OR (US); James P Dickie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3836 days.

(21) Appl. No.: 09/587,446

(22) Filed: Jun. 5, 2000

(51) Int. Cl.
*G09G 3/36* (2006.01)

(52) U.S. Cl.
USPC ..... 345/88; 345/102

(58) Field of Classification Search
USPC ..... 345/72, 61, 62, 63, 83–102, 150, 345/295, 690–698
See application file for complete search history.

(56) References Cited

U.S. PATENT DOCUMENTS

| | | | | |
|---|---|---|---|---|
| 4,966,441 | A * | 10/1990 | Conner | 349/6 |
| 5,428,408 | A | 6/1995 | Stanton | |
| 5,580,142 | A | 12/1996 | Kurematsu et al. | |
| 5,612,753 | A | 3/1997 | Poradish et al. | |
| 5,654,775 | A | 8/1997 | Brennesholtz | |
| 5,751,385 | A * | 5/1998 | Heinze | 349/61 |
| 5,859,735 | A * | 1/1999 | De Vries | 313/478 |
| 5,956,006 | A * | 9/1999 | Sato | 345/605 |
| 6,129,444 | A * | 10/2000 | Tognoni | 362/231 |
| 6,147,720 | A | 11/2000 | Guerinot et al. | |
| 6,160,596 | A * | 12/2000 | Sylvester et al. | 349/61 |
| 6,252,636 | B1 | 6/2001 | Bartlett | |
| 6,304,237 | B1 * | 10/2001 | Karakawa | 345/83 |
| 6,337,536 | B1 * | 1/2002 | Matsubara et al. | 257/461 |
| 6,366,270 | B1 * | 4/2002 | Evanicky | 345/589 |
| 6,371,617 | B1 | 4/2002 | Nishida et al. | |
| 6,398,389 | B1 | 6/2002 | Bohler et al. | |
| 6,409,349 | B1 | 6/2002 | O'Connor | |
| 6,505,939 | B1 | 1/2003 | Bierhuizen et al. | |
| 6,561,654 | B2 | 5/2003 | Mukawa et al. | |
| 6,688,747 | B2 | 2/2004 | Wichner et al. | |
| 6,733,139 | B2 | 5/2004 | Childers et al. | |
| 2002/0186349 | A1 | 12/2002 | Wichner et al. | |

FOREIGN PATENT DOCUMENTS

| | | | |
|---|---|---|---|
| EP | 1405137 | | 4/2004 |
| GB | 2312121 | | 10/1997 |
| JP | 9050082 | | 2/1997 |
| JP | 2000-206452 | A | 7/2000 |
| JP | 2000-305040 | A | 11/2000 |
| JP | 2001-102846 | A | 4/2001 |
| JP | 2001-272722 | A | 10/2001 |
| JP | 2002-054846 | A | 2/2002 |
| JP | 2002-174854 | A | 6/2002 |
| JP | 2002-296680 | A | 10/2002 |
| JP | 2003-255465 | A | 9/2003 |
| WO | WO-02/101459 | A1 | 12/2002 |

OTHER PUBLICATIONS

European Examination Report under Section 18(3) received in EP Application No. 0309639.3, mailed Feb. 25, 2005, 3 pages.

* cited by examiner

*Primary Examiner* — Vijay Shankar

(57) ABSTRACT

A liquid crystal display (LCD) panel has a variable white balance. The LCD panel includes an LCD screen, a first light source, a second light source and a light path directing the first and second light sources onto the LCD screen and a control circuit used to adjust the relative intensities of the first and second light sources. The first light source has a first color spectrum and the second light source a second color spectrum. The color spectrums of the first and second light sources are mixed in the light path to create a balanced white spectrum.

20 Claims, 8 Drawing Sheets

MULTI-SOURCE LCD BACKLIGHT FOR WHITE BALANCE ADJUSTMENT

FIELD OF THE INVENTION

The invention relates to liquid crystal display panels, more specifically, the invention concerns using multiple backlight sources to provide for white balance adjustment.

BACKGROUND OF THE INVENTION

Display users often want to adjust the color of white on their display monitor to suit their personal preferences. This color adjustment is referred to as balancing the "white point." This color adjustment is often available on cathode ray tube (CRT) monitors, but it is not on liquid crystal display (LCD) monitors, particularly those used in portable computers and other electronic devices such as LCD monitors and personal data assistants. On a CRT monitor, adjusting the relative gains of the red (R), green (G), and blue (B) voltage amplifiers changes the white point. Because CRTs are analog systems, this is accomplished fairly easily. However, LCDs are typically digital systems, such that the RGB colors from them are produced directly by digital to analog converters. These converters are typically ganged together thus changing the gain of a subset is difficult, and would require different driver designs than those currently used. In addition, the liquid crystal cells (pixels) operate within a limited voltage range. To achieve the maximum amount of colors available to be viewed, the entire voltage range should be used. Changing the relative gain of a particular color to adjust the white balance would restrict the amount of the liquid crystal electrooptic curve available to the cell. This restriction lowers performance of the display by negatively affecting the contrast, response time, and gamma. Essentially, the liquid crystal cells act as "light valves" and white balance schemes that change the nature of these valves necessarily change the display's performance. What is needed is an apparatus and method of adjusting the white balance of LCD monitors that does not affect the liquid crystal cells and consequently the performance of the display.

SUMMARY

A liquid crystal display (LCD) panel has a variable white balance. The LCD panel includes an LCD screen, a first light source, a second light source and a light path directing the first and second light sources onto the LCD screen and a control circuit used to adjust the relative intensities of the first and second light sources. The first light source has a first color spectrum and the second light source a second color spectrum. The color spectrums of the first and second light sources are mixed in the light path to create a balanced white spectrum.

DETAILED DESCRIPTION OF THE EMBODIMENTS

Figure 1:
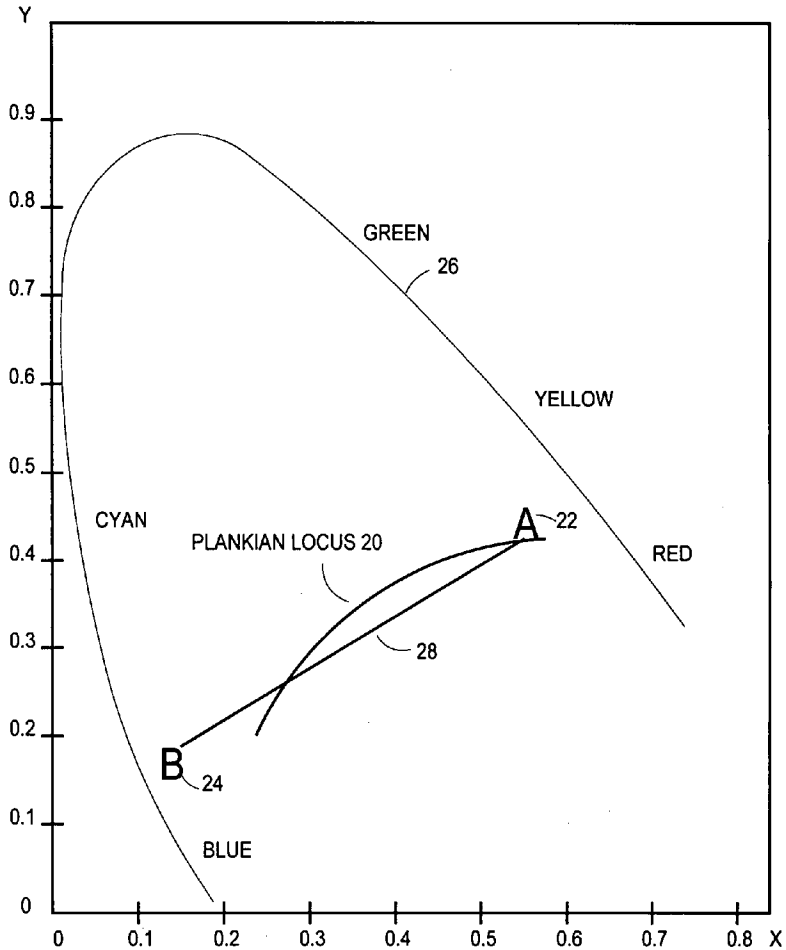
FIG. 1 is a graph illustrating the CIE 1931 Chromaticity Diagram and the Plankian locus of white points and one method of selecting a particular white point.

A common technique for specifying color is a "chromaticity diagram." A chromaticity diagram plots color using two unitless numbers. One example is the Commission Internationale L'Eclairage (CIE) 1931 chromaticity diagram. The CIE 1931 diagram has the colors of the electromagnetic spectrum fall around a curved boundary. A color is represented as a single point such a diagram that falls within the curved boundary. It is a characteristic of such chromaticity diagrams that given two different colors with corresponding points on the diagram, mixing the two colors results in new colors represented on a straight line drawn between the two original points. Location along the line is determined by the relative intensity of the two mixed colors. Therefore, if light from two different light sources are mixed to form the backlight for an LCD, the relative brightness of the two sources would place the resulting white point somewhere on a line between the points on the CIE 1931 diagram represented by the respective colors of the two light sources. Changing the relative brightness of two light sources requires that the display panel be designed to support backlight from multiple light sources at the same time FIG. 1 is an exemplary illustration of the CIE 1931 chromaticity diagram. A curved boundary 26 contains the electromagnetic spectral colors. Within the curved boundary 26 lies other colors which represent a mix of the spectral colors. Also shown is another curved line representing the "Plankian locus" 20. The Plankian locus 20 is the locus of colors that exist from the full range of temperatures of a black body radiator, and generally represents the range of various shades of white. Point A 22 is an example of a "cool" white. Point B 24 is a point representing a nearly spectrally pure blue color. By mixing some of color B into the white A, different shades of white can be produced, all of which exist along the straight AB line 28. It is desirable for whites to fall near the Plankian locus 20 and it can be seen that mixing different amounts of color B with the cool white A results in a wide range of whites that fall on or near the Plankian locus 20.

Figure 2:
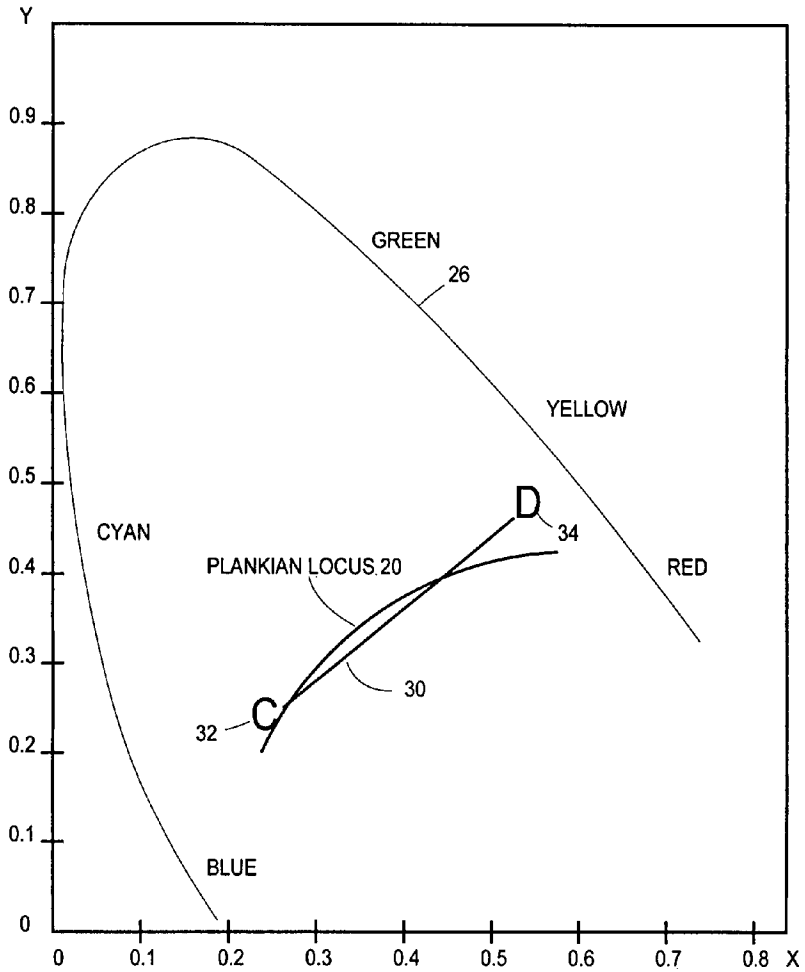
FIG. 2 is a graph illustrating the CIE 1931 Chromaticity Diagram and the Plankian locus of white points and a first alternative method of selecting a particular white point.

FIG. 2 illustrates an alternative approach if a "hot" white light source at point C 32 is used. In this embodiment, a color at point D 34 is used to provide a straight CD line 30 that falls near the Plankian locus 20. Alternatively, both a "hot" white light source and a "cool" white light source could be used and the available white balance point can be chosen by changing the relative intensities of the light sources.

Figure 3:
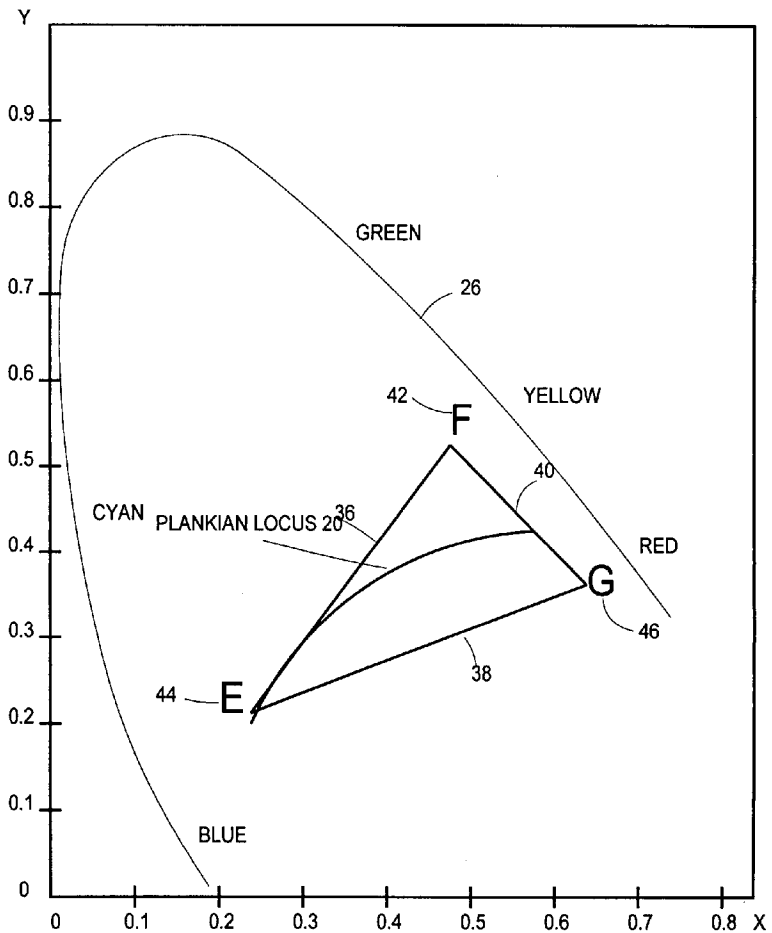
FIG. 3 is a graph illustrating the CIE 1931 Chromaticity Diagram and the Plankian locus of white points and a second alternative method of selecting a particular white point.

FIG. 3 illustrates another alternative method if more precision in selecting the white balance point is required. In this embodiment, two additional light sources are mixed with "hot" white point E light source 44. A nearly spectral yellow point F 42 light source is combined with a nearly red point G 46 light source to form a triangular region in which the light from the multiple sources can be combined through mixing. The triangle is formed with EG line 38, EF line 36, and FG line 40. Here the triangle essentially and substantially encompasses the complete Plankian locus 20. Thus by properly selecting the appropriate color mixture, the resultant white color balance can essentially fall on the Plankian locus 20.

Figure 4B:
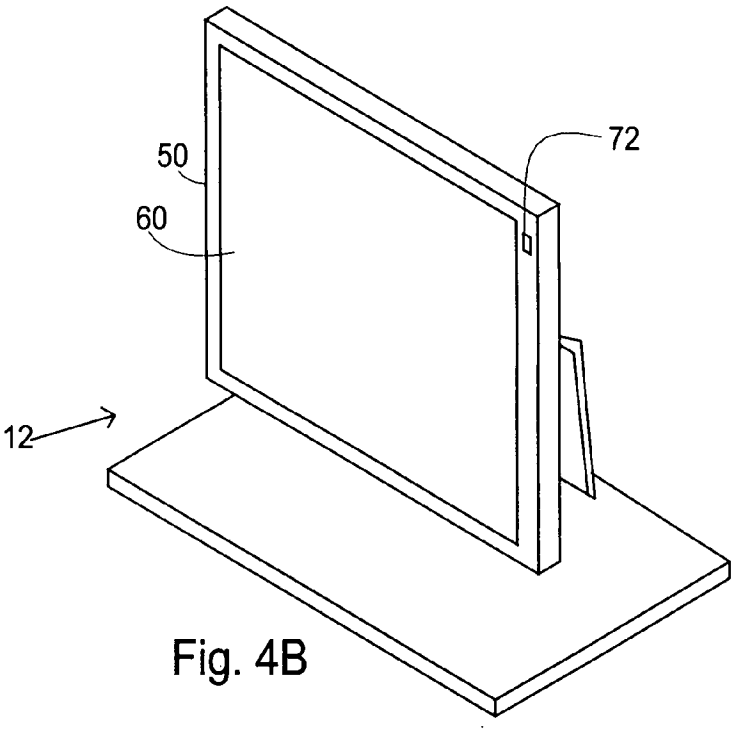
FIG. 4B is an illustration representing a display viewing panel that incorporates an embodiment of the invention.
Figure 4A:
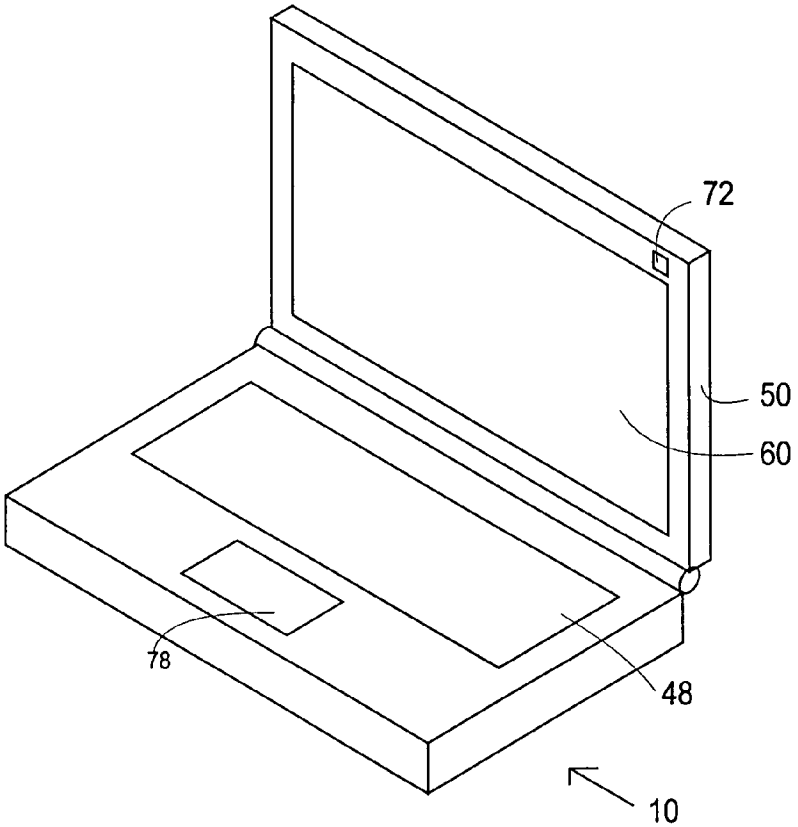
FIG. 4A is an illustration representing a notebook computer that incorporates an embodiment of the invention.

FIG. 4A is an illustration of an exemplary portable computer 10 having a display housing 50 containing display panel 60 that has variable white balance as provided by the invention. The display housing 50 is attached to a lower housing that includes keyboard 48 and input device 78. An optional sensor 72 is used to monitor the ambient light conditions or alternatively the light intensity and color spectrum emitted from the display panel 60.

FIG. 4B is an illustration of an LCD monitor screen 12 having a display housing 50 containing display panel 60 that has a variable white balance as provided by the invention. An optional sensor 72 is used to monitor the ambient light conditions or alternatively the light intensity and color spectrum emitted from the display panel 60.

Figure 5A:
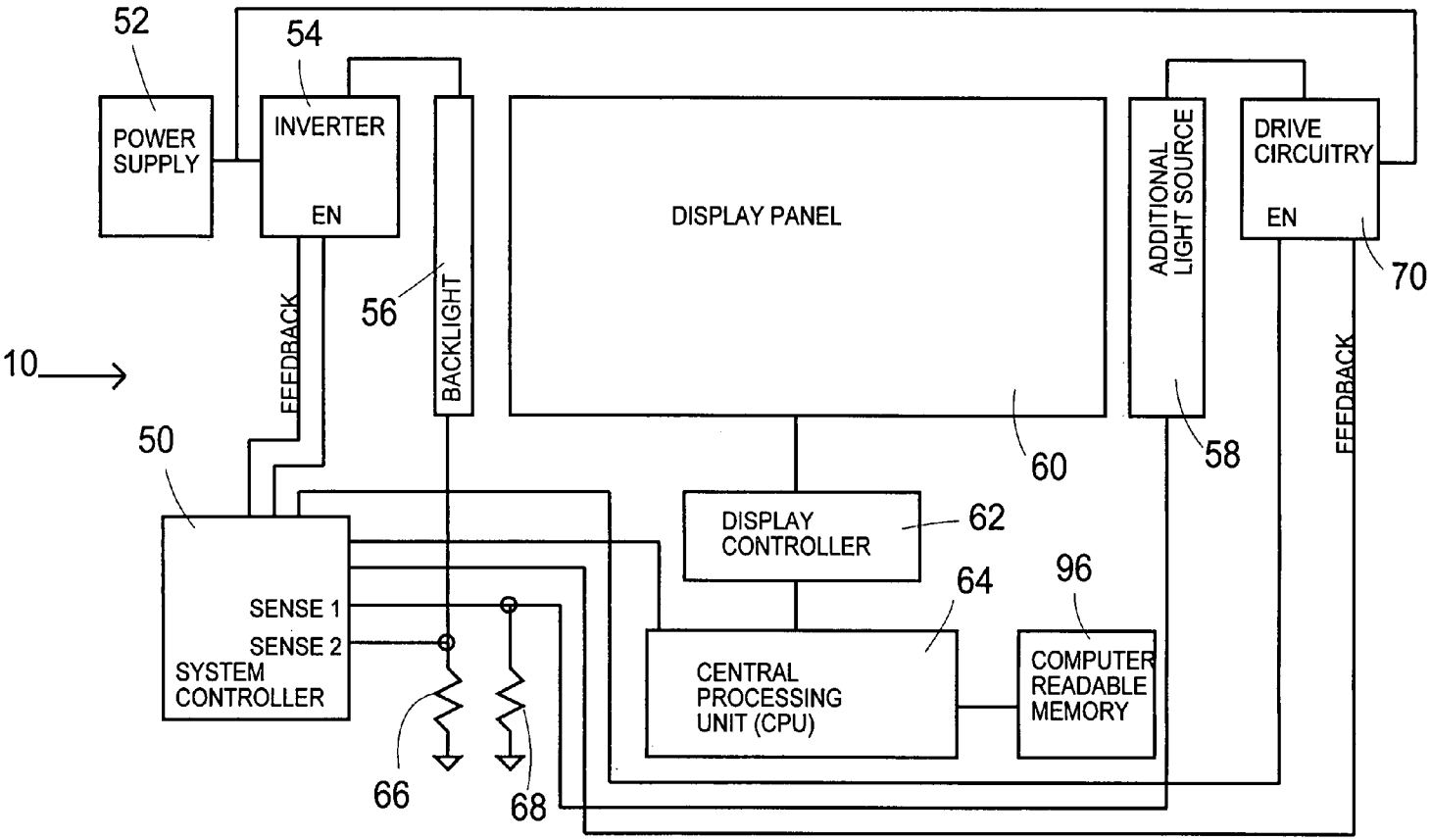
FIG. 5A is an exemplary block diagram of circuitry used to implement an embodiment of the invention.

FIG. 5A is an exemplary block diagram of circuitry used to implement the white balance adjustment of the invention for the portable computer 10 of FIG. 4 A. Portable computer 10 includes a central processing unit (CPU) 64, i.e. an Intel Pentium type processor, which connects to a display controller 62, i.e. an ATI Mobility 3D graphics controller. The display controller 62 is further connected to and controls the images upon the display panel 60. The display panel 60 is illuminated with at least two light sources, a backlight 56, typically but optionally a cold cathode fluorescent (CCFL) light source, and an additional light source 58 via an optical path, preferably a light pipe. A power supply 52 provides the energy to drive the light sources using an inverter 54 for backlight 56, preferably a CCFL tube, and drive circuitry 70 for the additional light source 58. The drive circuitry 70 may be an inverter if the additional light source 58 is a CCFL tube or other appropriate power conversion devices if the additional light source is an electroluminescent (EL) panel or light emitting diode (LED) array. The LED array may be comprised of a single or multiple colors of individual LEDs to provide a particular color point on the CIE 1931 diagram. The inverter 54 and drive circuitry 70 are enabled and feedback controlled by a system controller 50. The system controller 50 is typically a general-purpose microcontroller, microprocessor, or digital signal processor such as a National Semiconductor PC87570, however other control circuits could be implemented using discrete logic or programmable logic arrays and still meet the spirit and scope of the invention. The system controller 50 can sense the amount of current through the light sources through sense resistors 66 and 68 by reading the voltage appearing across them. The CPU 64 is also attached to computer readable memory 96. Computer readable memory 96 holds an executable program that can be used to configure and control the settings of the light sources to allow a user to choose the desired optimum white balance point. CPU 64 is connected to system controller 50 to communicate the chosen settings.

The intensity of the light sources may be changed by adjusting the voltage and current supplied to the light sources. However, such as with a CCFL or LED light source, the usable voltage and current ranges are limited wherein the light output is stable. Therefore, an alternative approach is to supply a voltage and current to each light source that is within the region of operating stability and then to independently change the duty cycle of the power (voltage and current) supplied to one or both of the light sources.

Figure 5B:
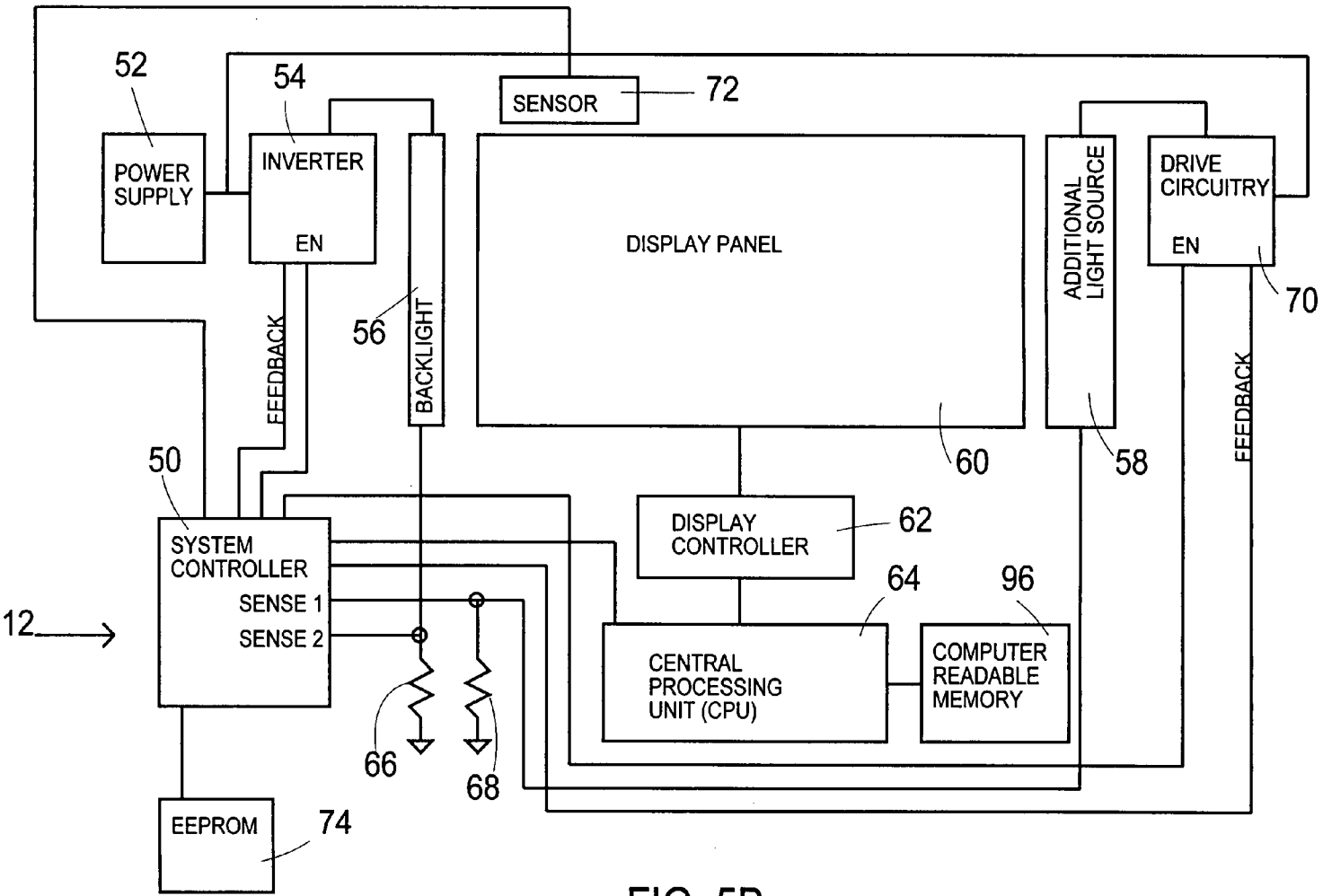
FIG. 5B is an exemplary block diagram of circuitry used to implement an alternative embodiment of the invention.

FIG. 5B is an alternative exemplary block diagram for circuitry used to implement an alternative embodiment of the invention such as in LCD monitor screen 12. In addition to the blocks described for FIG. 5A, this embodiment includes a sensor 72 and EEPROM memory 74 connected to the system controller 50. The system controller 50 can read the output of sensor 72 and adjust the display white balance point accordingly to accommodate changes due to aging in the backlight 56 and ambient lighting conditions. Calibration settings for selecting the relative intensity of the light sources are stored in EEPROM memory 74. The light source output may change due to warm-up, aging and changes in ambient lighting that affect both the apparent color and intensity of the display. The sensor 72 is used to detect the intensity of backlight 56 and then adjust the output of the additional light source 58 in response to maintain a chosen white balance and to optionally maintain the original intensity constant. This feedback control maintains white balance when the backlight 56 output changes due to warm-up or aging effects. By using a sensor 72 that can detect the color of ambient light color spectrum, then the output of sensor 72 can be used by the control circuit in a feedback arrangement to adjust the output of additional light source 58 relative to backlight 56 to compensate for changes in the ambient light color spectrum changes. The sensor 72 is optionally a single pixel that detects intensity. Alternatively, a single pixel sensor 72 may have one or more movable filters to allow detecting the color of light reaching the pixel. Sensor 72 may also be made up of multiple pixels. Using two pixels with separate filters having colors mapped to two points on the CIE 1931 chromaticity diagram that span the Plankian locus will allow the sensor 72 to detect various white balance levels. Using three pixels for sensor 72 with three primary colors allows a sensor 72 that can detect multiple colors on the CIE 1931 diagram. Other methods of constructing sensor 72 allow detection of color or intensity exist and their use would still meet the spirit and scope of the invention.

Figure 6:
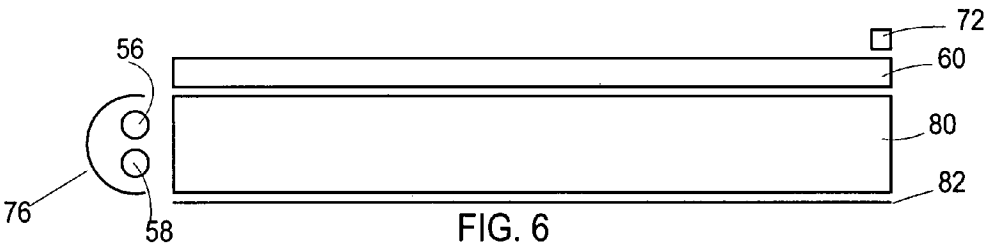
FIG. 6 is an exemplary illustration showing the construction of an embodiment of the invention.

FIG. 6 is an illustration of a first embodiment of one possible construction of the invention. In this embodiment two CCFL light sources are used to provide two different black body radiation white sources. The relative intensity of the two CCFL tubes allows the selection of a white balance point on a line between two points on the CIE 1931 diagram. Hot CCFL 56 is positioned adjacent to cool CCFL 58. The light emanating from the two CCFL tubes are radiated directly and indirectly using large reflector 76 into an optical path, light pipe 80, which is positioned behind display 60. Light pipe 80 is designed to evenly spread out and mix the light reaching display 60. Optionally, a reflective sheet 82 can be positioned on one side of the light pipe 80 as shown to increase the amount of light reaching display 60 by redirecting light that leaks out from the rear of light pipe 80. Optional sensor 72 is positioned near the edge of the display to monitor the light spectrum or intensity leaving the display. Other positions can be used and still meet the spirit and scope of the invention.

Figure 7:
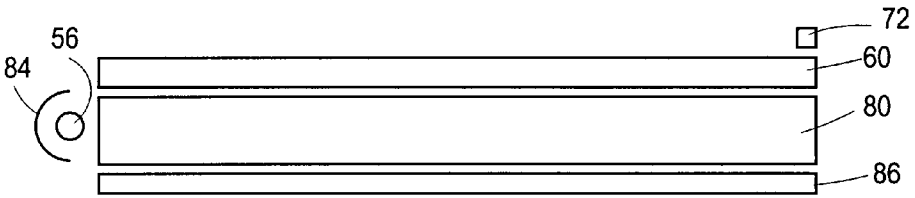
FIG. 7 is an exemplary illustration showing the construction of a first alternative embodiment of the invention.

FIG. 7 is an illustration of a second embodiment of constructing an implementation of the invention. In this second embodiment, a single CCFL 56 is positioned to radiate directly and indirectly using small reflector 84 light into the optical path, light pipe 80, to illuminate display 60. A second light source 86 is preferably implemented using an EL panel, but optionally an light emitting diode array, to direct light through the backside of the light pipe 80 and mix with the light from CCFL 56 before exiting onto the display 60. In this implementation, the single CCFL 56 is chosen to be either a "hot" or "cool" CCFL light source and the color of the second light source is chosen to be complementary in color such that a direct line between the two points representing the colors of the two light sources on a CIE 1931 plot is disposed substantially near the Plankian locus as exemplary illustrated in FIG. 1 and FIG. 2.

Figure 8:
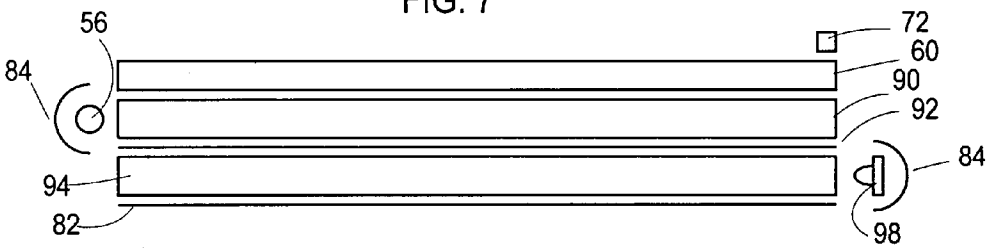
FIG. 8 is an exemplary illustration showing the construction of a second alternative embodiment of the invention.

FIG. 8 is an illustration of a third embodiment of constructing an implementation of the invention. In this embodiment, a single CCFL 56 is positioned to radiate light directly and indirectly using small reflector 84 into a first optical path, light pipe 90. The light pipe 90 is designed to evenly disburse the light onto the back surface of display 60. A second light source 98, preferably an LED array, but optionally another CCFL tube is used to direct light into a second optical path, a light pipe 94, that directs light onto the light pipe 90, which mixes light from CCFL 56 with second light source 98. The mixed light exits light pipe 90 onto the back of display 60. Optionally, a partial reflector 92 is disposed between first light pipe 90 and second light pipe 94 such that there is a high transmistivity of light from second light pipe 94 onto first light pipe 90, and a high reflectivity of light from first light pipe 90 back onto itself. Thus, partial reflector 92 acts as a "one way mirror." If required due to the construction of second light source 98, i.e. a CCFL tube, a small reflector 84 may be optionally positioned to reflect light from the second light source back into the second light pipe 94. Optionally, a reflective sheet 82 can be positioned on one side of the second light pipe 94 as shown to increase the amount of light reaching display 60.

Figure 9:
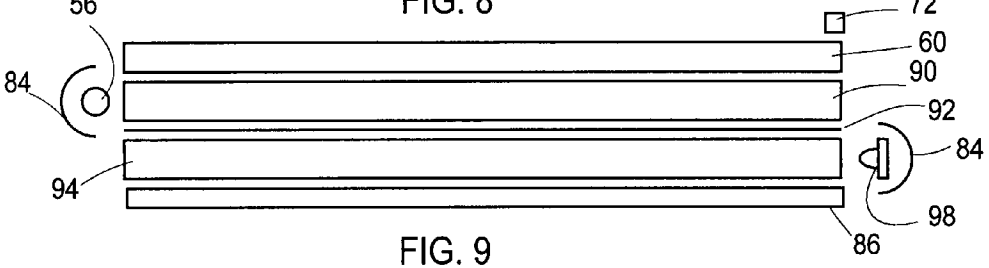
FIG. 9 is an exemplary illustration showing the construction of a third alternative embodiment of the invention.

FIG. 9 is an illustration of a fourth embodiment of constructing an implementation of the invention. In this embodiment the physical embodiment of FIG. 8 is used, however, the optional reflective sheet 82 is replaced with an EL panel 86 behind second light pipe 94 to provide a third light source. In this implementation, the white balance point can be chosen by varying the relative intensities of the single CCFL 56, second light source 98 and EL panel 86, which are mixed in light pipe 90. Single CCFL 56, second light source 98 and EL panel 86 are chosen to provide three points on the CIE 1931 plot such that the Plankian locus is substantially encompassed by a triangle formed by the three points as shown in FIG. 3.

Figure 10:
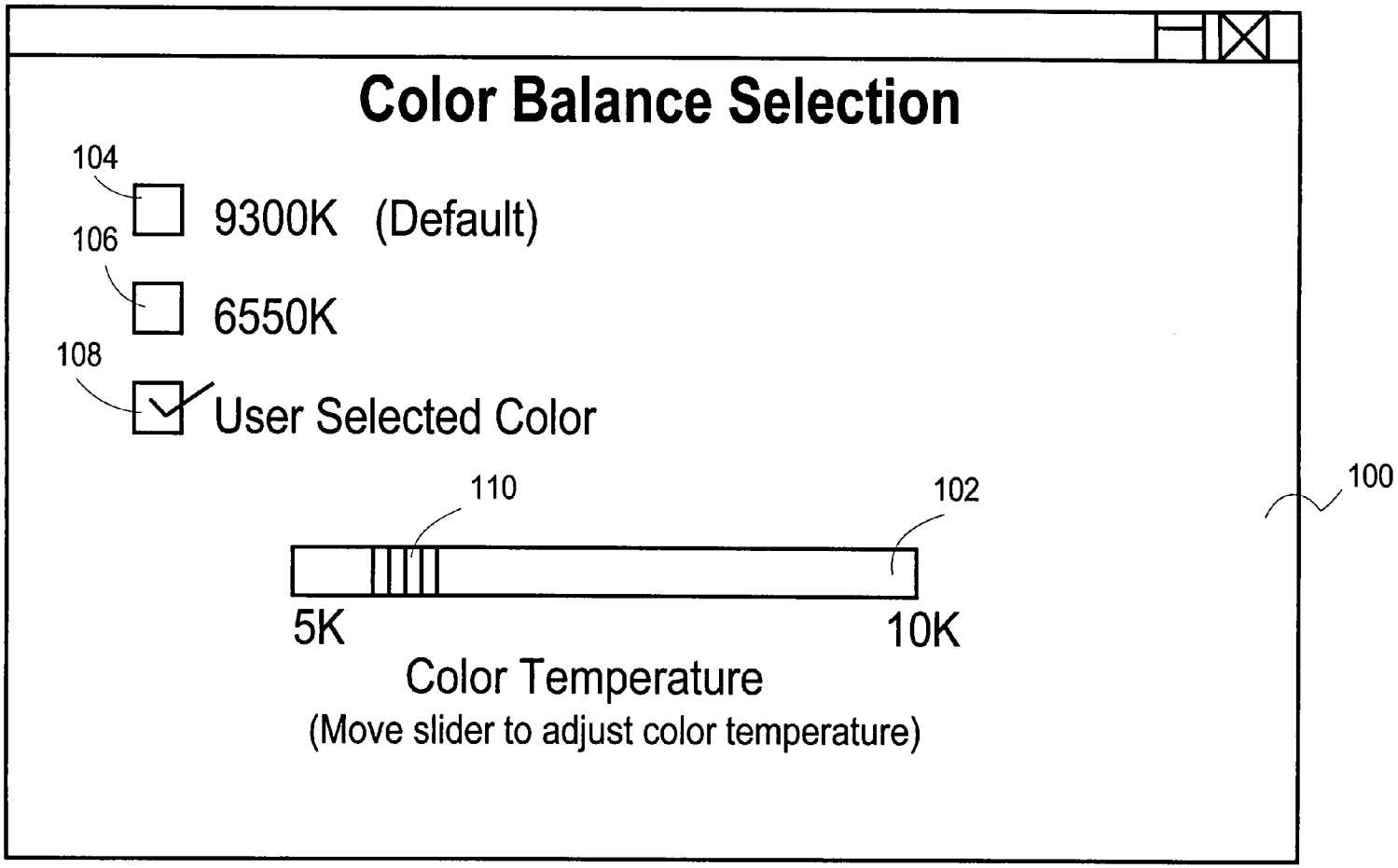
FIG. 10 is an exemplary configuration screen that allows a user to select a desired white balance point.

FIG. 10 is an illustration of a computer set up screen 100 that allows a user to chose the desired white balance point of the display backlight. When this set up screen 100 is presented to the user, the user may chose between common fixed settings, i.e. the 9300K box 104, the default, and the 6550K box 106, or the user may select a user selected color box 108. When the user selected color box 108 is chosen, the user may then move slider 110 along slider control 102 to select among the available white point settings, i.e. 5K and 10K in this illustration.

Although several different embodiments have been shown and described, those skilled in the art will appreciate that several different modifications can be made and still come within the spirit and scope of the invention. Accordingly, the invention is only limited by the following claims.

What is claimed is:

1. A liquid crystal display (LCD) panel having a variable white balance, comprising:

an LCD screen;

a first light source having a first color spectrum;

a second light source having a second color spectrum;

an optical path directing said first light source and said second light source onto said LCD screen;

a control circuit for adjusting the relative intensity of said first and second light source wherein said first light source and said second light source are mixed in the optical path thereby creating a white balanced spectrum;

a sensor for detecting the ambient light color spectrum; and a feedback control circuit connected to the control circuit wherein the feedback control circuit adjusts the relative light intensity of the first and second light sources to compensate for changes in ambient light color spectrum changes.

2. The LCD panel of claim 1, wherein said first and second light sources are cold cathode fluorescent (CCFL) tubes.

3. The LCD panel of claim 1, wherein said first light source is a CCFL tube and said second light source is an electroluminescent panel.

4. The LCD panel of claim 1, wherein said first light source is a CCFL tube and said second light source is comprised of at least one light emitting diode.

5. The LCD panel of claim 4, wherein said second light source is comprised of at least two different color light emitting diodes.

6. The LCD panel of claim 1, wherein at least one of said first and second light source intensity is varied by changing the duty cycle of power to said at least one first and second light source.

7. An electronic device comprising the LCD panel of claim 1.

8. The electronic device of claim 7 further comprising computer readable memory holding a configuration program for selecting a desired white balance.

9. An electronic device, comprising:

a sensor for detecting the ambient light color spectrum;

a liquid crystal display (LCD) panel having a variable white balance, including, an LCD screen, a first light source having a first color spectrum, a second light source having a second color spectrum, an optical path directing said first light source and said second light to source onto said LCD screen, and a control circuit for adjusting the relative intensity of said first and second light source wherein said first light source and said second light source are mixed in the optical path thereby creating a white balanced spectrum; and a feedback control circuit connected to the control circuit wherein the feedback control circuit adjusts the relative light intensity of the first and second light sources to compensate for changes in ambient light color spectrum changes.

10. An electronic device, comprising:

an liquid crystal display screen;

a first light source having a first color spectrum;

a second light source having a second color spectrum;

an optical path directing the first and second light sources onto the liquid crystal display screen;

a sensor for detecting the ambient light color spectrum; and a control circuit including a feedback control circuit connected to the sensor for adjusting the relative intensity of said first and second light source to compensate for changes in ambient light color spectrum changes wherein said first light source and said second light source are mixed in the optical path thereby creating a white balanced spectrum.

11. A method for adjusting the white balance on a liquid crystal display (LCD), comprising the steps of:

detecting the ambient light color spectrum;

illuminating the LCD with a first light source having a first color spectrum;

illuminating the LCD with a second light source having a second color spectrum; and adjusting the relative intensity of the first and second light sources to compensate for changes in ambient light color spectrum changes thereby mixing said first and second color spectrums to create a white balanced spectrum.

12. The method of claim 11 wherein the step of illuminating the LCD with a first light source further comprises the step of illuminating the LCD with a CCFL light source.

13. The method of claim 12 wherein the step of illuminating the LCD with a second light source further comprises the step of illuminating the LCD with a CCFL light source.

14. The method of claim 12 wherein the step of illuminating the LCD with a second light source further comprises the step of illuminating the LCD with a electroluminescent light source.

15. The method of claim 12 wherein the step of illuminating the LCD with a second light source further comprises the step of illuminating the LCD with at least one light emitting diode (LED).

16. The method of claim 15 wherein the step of illuminating the LCD with at least one light emitting diode (LED) further comprises the step of illuminating the LCD with at least two different colors of LEDs.

17. The method of claim 11 wherein the step of adjusting the relative intensities further comprises the step of changing the duty cycle of power supplied to at least one of the first and second light sources.

18. The method of claim 11, wherein the step of adjusting the relative intensities further comprises the step of selecting a desired white balance spectrum.

19. A display panel using the method of claim 11 to adjust white balance.

20. An electronic device having a display using the method of claim 11 to adjust white balance on the display.

* * * * *

UNITED STATES PATENT AND TRADEMARK OFFICE

CERTIFICATE OF CORRECTION

PATENT NO. : 8,487,850 B1
APPLICATION NO. : 09/587446
DATED : July 16, 2013
INVENTOR(S) : James R Cole et al.

It is certified that error appears in the above-identified patent and that said Letters Patent is hereby corrected as shown below:

In the Claims:

In column 6, line 40, in Claim 9, delete “light to” and insert -- light --, therefor.

Signed and Sealed this
Twenty-fourth Day of September, 2013

Teresa Stanek Rea
*Deputy Director of the United States Patent and Trademark Office*